US011583711B2

(12) United States Patent
Mamie et al.

(10) Patent No.: US 11,583,711 B2
(45) Date of Patent: Feb. 21, 2023

(54) CABLE HOLDER AND RUNNING ELEMENT

(71) Applicant: SPANSET INTER AG, Wollerau (CH)

(72) Inventors: Andre Mamie, Waedenswil (CH); David Ehnimb, Thalwil (CH)

(73) Assignee: SPANSET INTER AG, Wollerau (CH)

( * ) Notice: Subject to any disclaimer, the term of this patent is extended or adjusted under 35 U.S.C. 154(b) by 0 days.

(21) Appl. No.: 16/615,515

(22) PCT Filed: May 18, 2018

(86) PCT No.: PCT/IB2018/000809
§ 371 (c)(1),
(2) Date: Nov. 21, 2019

(87) PCT Pub. No.: WO2018/215842
PCT Pub. Date: Nov. 29, 2018

(65) Prior Publication Data

US 2020/0114183 A1 Apr. 16, 2020

(30) Foreign Application Priority Data

May 23, 2017 (DE) ..... 10 2017 004 948.3

(51) Int. Cl.
*A62B 35/00* (2006.01)
*E04G 21/32* (2006.01)

(52) U.S. Cl.
CPC ..... *A62B 35/0087* (2013.01); *A62B 35/0068* (2013.01); *E04G 21/3276* (2013.01)

(58) Field of Classification Search
CPC ..... A62B 37/0087; A62B 35/0068; E04G 21/327; E04G 21/3276
See application file for complete search history.

(56) References Cited

U.S. PATENT DOCUMENTS 5,279,385 A * 1/1994 Riches ..... A62B 35/0087 182/36
5,979,599 A * 11/1999 Noles ..... A62B 35/0087 182/36
6,056,085 A * 5/2000 Cutter ..... A62B 35/0068 182/36
6,467,574 B2 * 10/2002 Lara ..... A62B 35/0087 182/36
6,511,249 B2 * 1/2003 Pelofi ..... E04G 21/3295 441/84

(Continued)

FOREIGN PATENT DOCUMENTS

EP 0273673 A1 7/1988
EP 1188459 A1 3/2002

(Continued)

OTHER PUBLICATIONS

International Preliminary Report on Patentability dated Nov. 26, 2019, in International Application No. PCT/IB2018/000809.

(Continued)

*Primary Examiner* — Daniel P Cahn
*Assistant Examiner* — Candace L Bradford
(74) *Attorney, Agent, or Firm* — Patent Central LLC; Stephan A. Pendorf

(57) ABSTRACT

A cable holder and a running element for a cable system of an anti-fall device, wherein the cable holder is reversibly rotatably mounted and the axis of rotation of the cable holder is offset parallel to a cable.

2 Claims, 2 Drawing Sheets

(56) References Cited

U.S. PATENT DOCUMENTS

Figure 1:
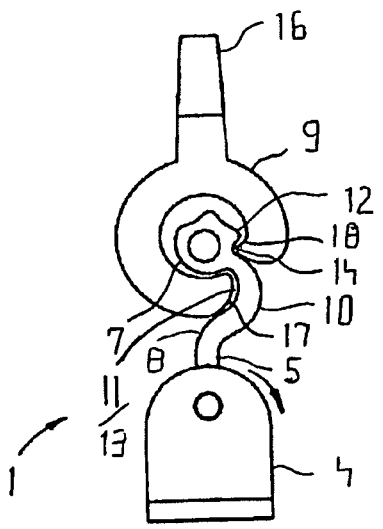

| | | | | |
|---|---|---|---|---|
| 8,499,896 | B2 * | 8/2013 | Midtgaard | B66B 7/02 187/407 |
| 9,364,695 | B2 * | 6/2016 | Chantelois | A62B 35/0081 |
| 10,420,967 | B2 * | 9/2019 | Poldmaa | E04G 21/329 |
| 10,619,417 | B2 * | 4/2020 | Ostrobrod | A62B 35/0087 |
| 2002/0050421 | A1 | 5/2002 | Lara | |
| 2006/0124391 | A1 * | 6/2006 | Jones | A62B 35/0081 182/36 |
| 2007/0261915 | A1 * | 11/2007 | Auston | A62B 35/0087 182/11 |
| 2007/0261925 | A1 * | 11/2007 | Givonetti | B62L 5/00 188/24.11 |
| 2011/0024230 | A1 * | 2/2011 | Mahr | E04G 21/3261 248/65 |
| 2018/0154197 | A1 * | 6/2018 | Riches | A62B 35/0087 |
| 2020/0114183 | A1 * | 4/2020 | Mamie | A62B 35/0068 |

FOREIGN PATENT DOCUMENTS

| | | | | |
|---|---|---|---|---|
| EP | 1716889 | A2 * | 11/2006 | A62B 35/0087 |
| EP | 2243981 | A1 * | 10/2010 | A62B 35/0068 |
| EP | 2269696 | A1 | 1/2011 | |
| EP | 2407211 | A1 | 1/2012 | |
| GB | 2395976 | A * | 6/2004 | A62B 35/0056 |
| GB | 2582587 | A * | 9/2020 | A62B 1/14 |
| WO | WO-2009133361 | A1 * | 11/2009 | A62B 35/0056 |
| WO | WO-2011101781 | A1 * | 8/2011 | A62B 35/0056 |

OTHER PUBLICATIONS

International Search Report dated Oct. 1, 2018, in International Application No. PCT/IB2018/000809.

* cited by examiner

CABLE HOLDER AND RUNNING ELEMENT

The invention relates to a cable holder and a running element for a cable system of an anti-fall device.

With known anti-fall devices with essentially horizontally arranged cables, there is a risk of canting of a running element with a cable holder when the running element is guided over a cable holder. This also applies when the running element, which is frequently a slit-type opening, has a so-called longitudinal slit running parallel to a cable in the cable holder, is arranged in an angular position that lies between 90° and 180° in relation to a holder for a carabiner or similar. This observation of the angular position is made with a cross-section profile at right angles to the longitudinal axis of the running element.

It has also been found that with such an angular position of the longitudinal slit, the cable holder cannot be mounted with a perpendicular running connecting piece, but always in the corresponding angular position when the holder of the running element should itself be kept vertical. However, this is a disadvantage due to the construction.

If a force acts on the running element in the direction of rotation of the running element on the cable while said running element is being guided over the cable holder, flexural forces act on the cable holder, and thus on the connecting piece, which can lead to a deformation of the cable holder, in particular of the connecting piece of the cable holder.

Accordingly, the object of the invention is to provide a running element and a cable holder for an anti-fall device with which a canting of the cable holder with the running element is avoided and the risk of a deformation of the cable holder as a result of the flexural forces acting on it is reduced.

The object is realized according to the invention by means of a cable holder and a running element for a cable system of an anti-fall device, wherein the cable holder is reversibly rotatable mounted and the axis of rotation of the cable holder is offset parallel to a cable.

Accordingly, the cable holder for an anti-fall device is reversibly rotatably supported and the axis of rotation of the cable holder is offset parallel to a cable.

In a further design of the invention, the cable holder has a console for a reliable form- and/or force-fit arrangement on a building structure, and a cable retainer. The cable retainer and the console are here connected to each other. The cable retainer is reversibly rotatably supported on the console. The axis of rotation of the cable retainer is offset parallel to a cable or to its holder. Here, it is assumed that the cable does not have a kink.

In order to ensure reversibility, the cable retainer and/or the console has at least one spring element. According to the invention, any known spring element may be used that is suitable for the construction.

In a further design, the cable retainer has a cable guide and a connecting piece, wherein the cable guide connects to the connecting piece at its free end facing away from the console. The connecting piece has a curved section, for example offset parallel in the cable direction, which connects to the cable guide and which extends in the direction of the console.

Here, the curved section generally connects with a running element on a contact area of the connecting piece when the running element functionally lies on the cable guide.

This can be a corrugation or an arch-shaped recess, for example. Offset parallel in the cable direction means that a longitudinal side or an axis of a cross-section profile of the connecting piece with its curved section runs parallel or essentially offset parallel to the cable. Preferably, the connecting piece, and therefore also the curved section, is arranged on the cable guide at right-angles to the cable guide.

The curved section of the connecting piece points in the direction of rotation of the cable holder in relation to an initial position which the cable holder adopts without a force effect. It is elevated in the angle of rotation, the direction in which the spring element is tensioned, as a result of which a particularly effective spring effect of the cable retainer is guaranteed. As a result of the curved section, the connecting piece has a spring effect and can thus provide a spring effect in addition to the reversibly rotatable support.

In one design of the invention, the cable holder does not have a cable holder supported in a reversibly rotatable manner. The cable guide has just one connecting piece, wherein the cable guide connects to the connecting piece as described and the connecting piece in a contact area with a running element offset parallel in the cable direction has the curved section described above. This then alone provides a spring effect of the connecting piece, and thus of the cable holder.

In both variants described above, it can therefore be provided that the curved section of the connecting piece forms a chamfer as a first guide for a running element, so that this can largely glide over the cable holder without jolting.

Here, it can additionally be provided that the cable guide—in the direction of rotation of the cable holder in relation to an initial position—has, at a transition point to the connecting piece with its curved section and opposite the chamfer, an elevation, such as a cam. A second guide can thus be formed together with the curved section of the connecting piece, which further supports the largely jolt-free gliding of the running element over the cable holder. Here, "opposite" means that the elevation is located on a surface of the curved section opposite the chamfer.

Further, in order to optimize gliding over, it can be provided that the front sides of the cable retainer, in particular of the cable holder, have an acute angular position in relation to the progression of the cable, in other words, they are chamfered surfaces. This also applies to the connecting piece.

It can also be provided that the first guide and the second guide are formed differently in respect of their cross-section profile. This guarantees that a running element can always only be guided over the cable guide in a predetermined arrangement. This serves to prevent a situation in which with a possible inverted introduction of the running element onto the cable, an angular position that is atypical for the device can be produced while being guided over the cable holder, with which, for example, a different leverage effect is produced when tensile forces act on the running element while being guided over the cable holder running radially to the cable. In cases of inverse guiding, the position can be so unfavorable that a guiding of the running element over the cable holder entails a large amount of effort for a person to be secured, since the running element must first be brought into an untypical position for the guiding. The aim is to prevent this with the solution.

Furthermore, the object is attained by means of a running element for an anti-fall device with a cable holder as described above—regardless of the form, but equipped with a first and a second guide—wherein the running element, as is known, has a longitudinal slit in a state that is functionally arranged on a cable running parallel to a cable of the cable holder. Here, the longitudinal slit is placed on a longitudinal side of the running element and laid in a defined angular position in relation to a retainer for a carabiner or similar between 90° and 180°, advantageously at 112°. Here, the running element has a first and an additional longitudinal slit edge. The first longitudinal slit edge is designed with regard to its form to correspond with the first guide of the cable holder, and the second longitudinal slit edge is designed with regard to its form to correspond to the second guide of the cable holder. This observation is made with a cross-section profile at right angles to the longitudinal axis of the running element. Here, it is further provided that the first longitudinal slit edge can interact with the first guide, and the second longitudinal slit edge can interact with the second guide in an easy clearance fit when the running element lies on the cable holder, i.e. the cable guide, as for a gliding over of the cable guide by the running element. A clearance fit in the sense of the invention means such a fit in which an easy gliding over is ensured and a canting of the running element is precluded. To this extent, depending on the specific design of the cable holder and its cable guide and of the running element, there is a certain degree of design flexibility.

The corresponding design described above, when the running element is laid on the cable guide, means that as a result, a form fit with a clearance fit of the running element with the cable guide is ensured during axial rotation, i.e. supported on the cable during rotation and the axis of the cable. As a result, the spring effect described above of the curved section or the connecting piece can fully take effect, in addition to the rotatably supported cable holder or cable retainer. This guarantees a minimization of canting at an angle to the running direction of the running element due to the guide thus created and its reversibly rotatable arrangement.

In a further design, front sides of the running element have an acute angular position in relation to the progression of the cable. These are chamfered surfaces, which provides an easy, jolt-free alignment of the running element with the cable retainer during guiding of the running element over the cable holder.

The invention will now be explained below on the basis of an exemplary embodiment, with reference to the figures. Here, additional advantages, features and designs of the invention are described.

Figure 2:
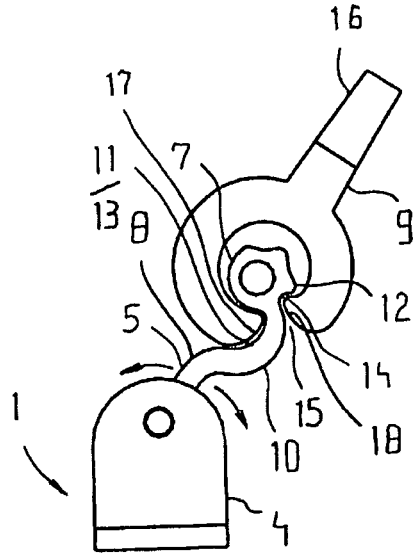
Figure 3:
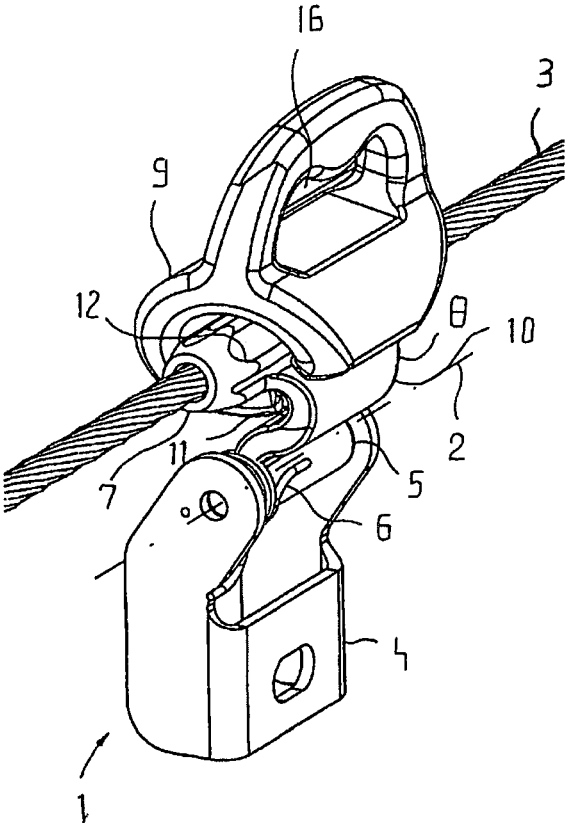

In the figures:

FIG. 1 and FIG. 2 show a cable holder according to the invention with an arranged running element, FIG. 3 shows a cable holder according to the invention with an arranged running element in a diagonal perspective with cable.

In FIGS. 1 to 3, a cable holder 1 according to the invention is shown interacting with a running element 9 according to the invention.

In the exemplary embodiment, the cable holder 1 for an anti-fall device has a console 4 for the secure functional arrangement on a building structure and a cable retainer 5.

The cable retainer 5 and the console 4 are here connected to each other. The cable retainer 5 is reversibly rotatably supported on the console 4. The axis of rotation 2 of the cable holder 4 or the cable retainer 5 is laid offset parallel to a cable 3 as shown in FIG. 3. In order to ensure reversibility, the cable retainer and/or the console 4 has one spring element 6.

Further, the cable retainer 5 has a cable guide 7 and a connecting piece 8, wherein the cable guide 7 connects to the connecting piece 8 as shown in the figures. The connecting piece 8 has a curved section 10 with a running element 9 as a separate component, offset parallel in the cable direction. The curved section 10 of the connecting piece 8 points in the direction of rotation of the cable holder 1 in relation to an initial position of the cable holder 1. The initial position is shown in FIG. 1.

The curved section 10 is elevated in the direction of rotation, as a result of which a spring effect of the connecting piece 8 and thus of the cable retainer 5 is guaranteed—even when this is generally lower in relation to a rotatable support. Thus, in addition to the reversible rotatable support of the cable retainer 5, a spring effect of said retainer is provided.

Furthermore, the curved section 10 of the connecting piece 8 forms a chamfer 11 as the first guide 13 for the running element 9, so that this can glide over the cable holder 1 in a largely jolt-free manner.

Further, the cable guide 7—in the direction of rotation of the cable holder 1, more precisely its cable retainer 5, in relation to the known initial position according to FIG. 1—has, at a transition point to the connecting piece 8 with its curved section 10 and opposite the chamfer 11, an elevation, which is designed in the exemplary embodiment as a cam 12. Thus, together with the curved section 10 of the connecting piece 8, a second guide 14 is formed, which further supports the largely jolt-free gliding of the running element 9 over the cable holder 1.

The first guide 13 and the second guide 14 are here formed differently with regard to their cross-section profile.

In the exemplary embodiment, the running element 9 that is arranged or arrangeable on the cable holder 1 has, as is known, a longitudinal slit 15 running parallel to the cable 3 of the cable holder 1, FIG. 3. Here, the longitudinal slit 15 is laid in a defined angular position of approx. 125° in relation to a retainer 16 for a known carabiner of a fall arrest device. The running element 9 has a first longitudinal slit edge 17 and a further longitudinal slit edge 18. The first longitudinal slit edge 17 is designed with regard to its form to correspond with the first guide 13 of the cable holder 1, and the second longitudinal slit edge 18 is designed with regard to its form to correspond to the second guide 14 of the cable holder 1. Due to the different form of the first guide 13 and the second guide 14, the first longitudinal slit edge 17 and a further longitudinal slit edge 18 also have a different design.

Here, it is provided that the first longitudinal slit edge 17 interacts with the first guide 13 and the second longitudinal slit edge 18 interacts with the second guide 14 in an easy clearance fit, when the running element 9 lies on the cable holder 1, as it does for a gliding over of the cable holder 1 and thus also of its cable guide 7 by the running element 9.

This design of the components, which corresponds to the form, means, as already explained above, that a form fit of the running element 9 with the cable holder 1 with a clearance fit is ensured when the running element 9 lies on the cable holder 1. The form fit prevents or minimizes canting. If tensile forces from a cable 3 of a fall arrest device laid on the retainer 16 are then emitted in the direction of rotation of the cable retainer 1, this leads to the rotation of the cable retainer 5, and if due to the design the reversible rotation is limited at a stop or other element, in other words, by the design of the spring element 6, this enables the described spring effect of the curved section 10 or the connecting piece 8 to have an additional effect after such a stop has been reached. This provides a reduction of the risk of canting of the running element 9 at an angle to its running direction. Thus, a reversibly movable, rotatable guide is created, which simplifies a guiding of the running element 9 over the cable holder 1.

LIST OF REFERENCE NUMERALS

1. Cable holder
2. Axis of rotation
3. Cable
4. Console
5. Cable retainer
6. Spring element
7. Cable guide
8. Connecting piece
9. Running element
10. Curved section
11. Chamfer
12. Cam
13. First guide
14. Second guide
15. Longitudinal slit
16. Retainer
17. First longitudinal slit edge
18. Further longitudinal slit edge

The invention claimed is:

1. A cable system of an anti-fall device, comprising
a running element (9),
a console (4) for secure attachment to a building structure, and
a cable retainer (5) comprising a cable guide (7) and a connecting piece (8),
the cable guide (7) having a cable bore having a cable bore axis,
the connecting piece (8) connects the console (4) with the cable guide (7),
wherein the running element (9) is adapted for running along a cable and passing over the cable guide (7),
wherein the connecting piece (8) in an area adapted to contact with the running element (9) has a curved section (10) offset from and parallel to the cable bore axis, the curved section (10) having a concave side and a convex side,
wherein the running element (9) comprises a retainer (16) adapted for retaining a carabiner and first and second jaws adapted for encircling and allowing passage through of the cable guide (7) between them, wherein the first and second jaws have ends defining between them a longitudinal slit (15) through which the curved section (10) of the connecting piece (8) can pass, with a first longitudinal slit edge (17) on the first jaw end and a second longitudinal slit edge (18) on the second jaw end, wherein the longitudinal slit (15) of the running element (9) runs parallel to the cable bore axis of the cable guide (7) of the cable holder (1), wherein the longitudinal slit (15) is arranged in an angular position that lies between 90° and 180° in relation to the retainer (16) which is at the 0° position, about the cable bore axis,
wherein the cable retainer (5) exhibits a first guide (13) for the running element (9) first slit edge (17) and a second guide (14) for the running element (9) second slit edge (18), wherein the first guide (13) is a first channel (11) and the second guide (14) is a second channel (15), wherein the first channel (11) is formed by the concave surface of the curved section (10) and the cable guide (7), wherein the cable guide (7) has a cam (12) which together with the convex side of the curved section (10) of the connecting piece (8) forms the second guide (14), and wherein a cross-section profile of the first guide (13) perpendicular to the cable bore axis is different from the cross-section profile the second guide (14) perpendicular to the cable bore axis,
the first longitudinal slit edge (17) shaped to be guided by the first guide (13) of the cable retainer (5), and the second longitudinal slit edge (18) shaped to be guided by the second guide (14) of the cable retainer (5), such that the first longitudinal slit edge (17) can interact with the first guide (13), and the second longitudinal slit edge (18) can interact with the second guide (14) in a clearance fit when the running element (9) lies on the cable guide (7) of the cable retainer (5).

2. A cable system of an anti-fall device, comprising
a running element (9),
a console (4) for secure attachment to a building structure, and
a cable retainer (5) comprising a cable guide (7) and a connecting piece (8),
the cable guide (7) having a cable bore having a cable bore axis,
the connecting piece (8) connects the console (4) with the cable guide (7),
wherein the running element (9) is adapted for running along a cable and passing over the cable guide (7),
wherein the connecting piece (8) in an area adapted to contact with the running element (9) has a curved section (10) offset from and parallel to the cable bore axis, the curved section (10) having a concave side and a convex side,
wherein the running element (9) comprises a retainer (16) adapted for retaining a carabiner and first and second jaws adapted for encircling and allowing passage through of the cable guide (7) between them, wherein the first and second jaws have ends defining between them a longitudinal slit (15) through which the curved section (10) of the connecting piece (8) can pass, with a first longitudinal slit edge (17) on the first jaw end and a second longitudinal slit edge (18) on the second jaw end,
wherein the cable retainer (5) exhibits a first guide (13) for the running element (9) first slit edge (17) and a second guide (14) for the running element (9) second slit edge (18), wherein the first guide (13) is a first channel (11) and the second guide (14) is a second channel (15), and wherein a cross-section profile of the first guide (13) perpendicular to the cable bore axis is different from the cross-section profile the second guide (14) perpendicular to the cable bore axis, the first longitudinal slit edge (17) shaped to be guided by the first guide (13) of the cable retainer (5), and the second longitudinal slit edge (18) shaped to be guided by the second guide (14) of the cable retainer (5), such that the first longitudinal slit edge (17) can interact with the first guide (13), and the second longitudinal slit edge (18) can interact with the second guide (14) in a clearance fit when the running element (9) lies on the cable guide (7) of the cable retainer (5),
wherein the connecting piece (8) is connected to the console (4) rotatably between a rest position and a spring-biased position,
further comprising a spring element (6) biasing the connecting piece (8) towards the rest position.

* * * * *